US010179718B2

(12) United States Patent
Stolt et al.

(10) Patent No.: US 10,179,718 B2
(45) Date of Patent: Jan. 15, 2019

(54) ELEVATOR CAR OVERLOAD MONITORING TO PREVENT STARTING

(71) Applicant: KONE Corporation, Helsinki (FI)

(72) Inventors: Lauri Stolt, Helsinki (FI); Risto Jokinen, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 427 days.

(21) Appl. No.: 15/092,725

(22) Filed: Apr. 7, 2016

(65) Prior Publication Data

US 2016/0221794 A1 Aug. 4, 2016

Related U.S. Application Data

(63) Continuation of application No. PCT/IB2014/065720, filed on Oct. 30, 2014.

(30) Foreign Application Priority Data

Nov. 1, 2013 (FI) ..... 20136072

(51) Int. Cl.
*B66B 1/34* (2006.01)
*B66B 5/14* (2006.01)

(52) U.S. Cl.
CPC ..... *B66B 5/14* (2013.01)

(58) Field of Classification Search
CPC ..... B66B 5/14
(Continued)

(56) References Cited

U.S. PATENT DOCUMENTS 4,337,846 A * 7/1982 Yonemoto ..... B66B 1/44 187/284
5,077,508 A * 12/1991 Wycoff ..... B66B 1/308 187/292

(Continued)

FOREIGN PATENT DOCUMENTS

CN 1910103 A 2/2007
CN 101298307 A 11/2008

(Continued)

*Primary Examiner* — Anthony Salata
(74) *Attorney, Agent, or Firm* — Birch, Stewart, Kolasch & Birch, LLP

(57) ABSTRACT

An elevator includes a control system for monitoring the load of a car, which control system is adapted to prevent the normal starting of the elevator, optionally also including relevelling, when there is an overload in the car. The elevator includes at least one position measuring device, speed measuring device and/or movement measuring device in order to determine the movement and/or position of the car, and the control system of the elevator is adapted to remove the prevention of normal starting when at least one said position measuring device, speed measuring device and/or movement measuring device detects that the car moved or is moving upwards in the elevator shaft. In the method, the control system of the elevator is used to determine the load situation of the car, including both the steps to prevent the normal starting of the elevator, optionally also including relevelling, when there is an overload in the car and to open some of the machinery brakes and to keep the remaining machinery brakes closed in order to determine the load situation.

16 Claims, 3 Drawing Sheets

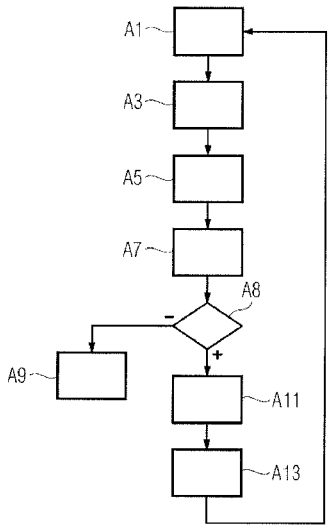

Legend

A1 - machinery brakes 160, 162 of elevator 1 are opened

A3 - the movement of car 102 is stopped by means of a moment accomplished by the motor current

A5 - the moment and load produced by motor 110 are calculated from the current of motor 110, preferably in the frequency converter of control system 114

A7 - the load information calculated in step A5 is exported from the frequency converter of control system 114 to the elevator control unit of control system 114

A8 - control unit 114 deduces, on the basis of the load information it has received, whether there is an overload in car 1 or not

A9 - if no overload is detected, the driving of elevator 1 begins

A11 - if an overload is detected, machinery brakes 160, 162 of elevator 1 are closed

A13 - the position of car 102 is examined and the overload information is kept active, until car 102 moves or moved upwards

(58) Field of Classification Search
USPC ..... 187/247, 248, 277, 284, 288, 289, 291, 187/305, 313, 391, 393
See application file for complete search history.

(56) References Cited

U.S. PATENT DOCUMENTS

| | | | | | |
|---|---|---|---|---|---|
| 5,183,979 | A * | 2/1993 | Sheridan | B66B 5/04 | 187/280 |
| 7,775,330 | B2 * | 8/2010 | Kattainen | B66B 5/04 | 187/287 |
| 7,921,969 | B2 * | 4/2011 | Stolt | B66B 1/30 | 187/293 |
| 8,365,873 | B2 * | 2/2013 | Viita-Aho | B66B 5/0031 | 187/314 |
| 8,584,812 | B2 * | 11/2013 | Dorsch | B66B 5/0031 | 187/287 |
| 8,869,945 | B2 * | 10/2014 | Harkonen | B66B 1/28 | 187/288 |
| 9,422,133 | B2 * | 8/2016 | Rebillard | B66B 1/32 | |
| 9,457,987 | B2 * | 10/2016 | Della Porta | B66B 1/32 | |
| 9,663,323 | B2 * | 5/2017 | Stolt | B66B 1/30 | |
| 9,828,211 | B2 * | 11/2017 | Schonauer | B66B 5/02 | |
| 2008/0271954 | A1 | 11/2008 | Fischer | | |
| 2010/0133046 | A1 | 6/2010 | Allwardt et al. | | |
| 2010/0300815 | A1 | 12/2010 | Stolt et al. | | |

FOREIGN PATENT DOCUMENTS

| | | | |
|---|---|---|---|
| CN | 102020186 | A | 4/2011 |
| CN | 102774720 | A | 11/2012 |
| CN | 103253563 | A | 8/2013 |
| FI | 20080535 | | 3/2010 |
| JP | 3-293277 | A | 12/1991 |
| JP | 2010-143692 | A | 7/2010 |
| WO | WO 2005/066057 | A2 | 7/2005 |
| WO | WO 2009/087266 | A1 | 7/2009 |
| WO | WO 2010/018298 | A1 | 2/2010 |

* cited by examiner

FIG 1

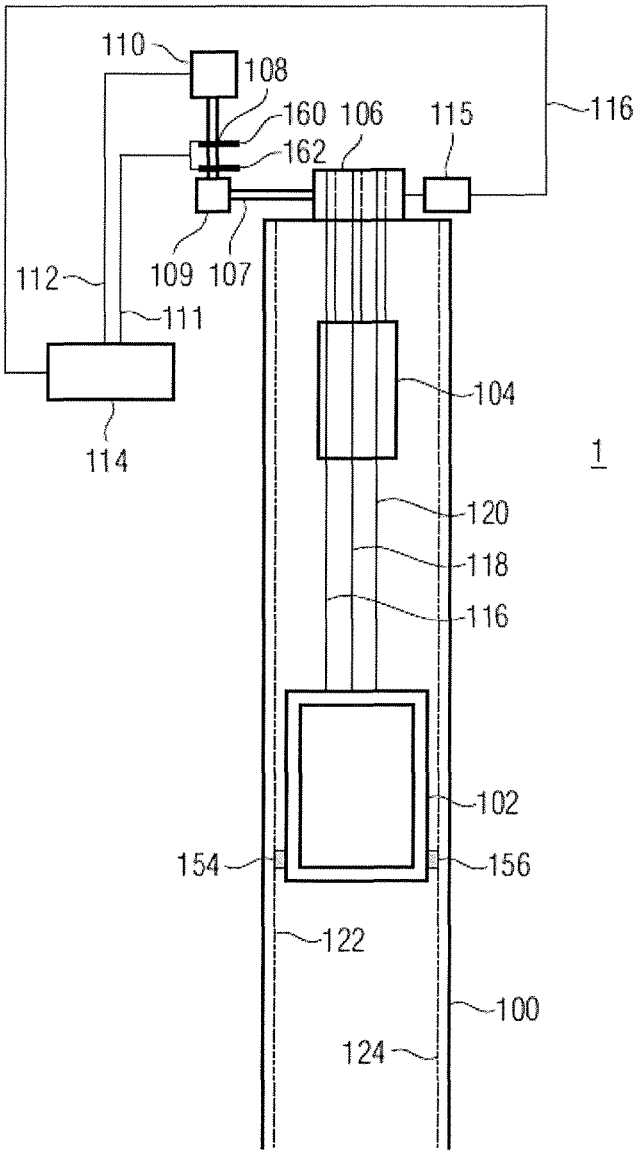

Legend:

1 - elevator
100 - elevator shaft
102 - elevator car
104 - counter weight
106 - drive sheaves
107 - shaft connecting power transmission 9 to drive sheaves
108 - shaft connecting motor 110 to power transmission
109 - power transmission
110 - motor
111 - control cable
112 - control cable
114 - frequency converter of control system
115 - position measuring device, speed measuring device and movement measuring device
116, 118, 120 - ropes
122, 124 - guide rails
154, 156 - car safety devices Prior Art

FIG 2

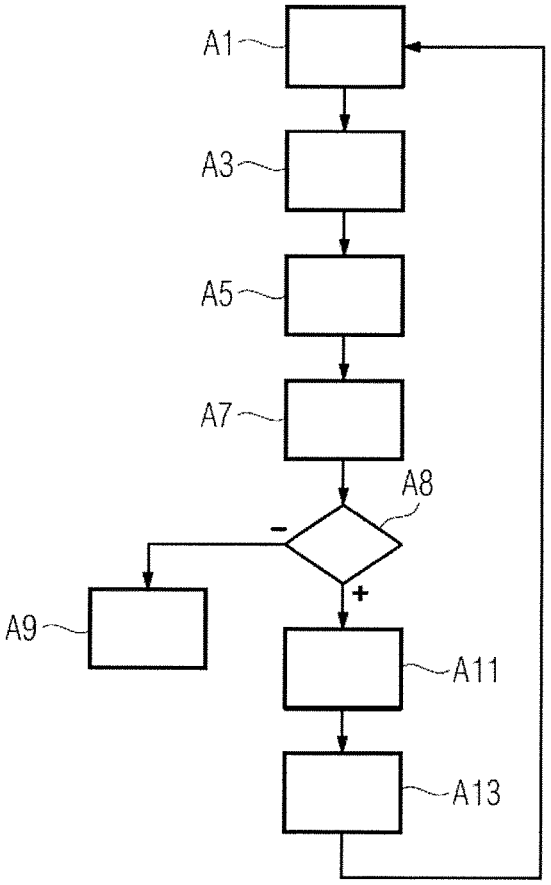

Legend

A1 - machinery brakes 160, 162 of elevator 1 are opened

A3 - the movement of car 102 is stopped by means of a moment accomplished by the motor current

A5 - the moment and load produced by motor 110 are calculated from the current of motor 110, preferably in the frequency converter of control system 114

A7 - the load information calculated in step A5 is exported from the frequency converter of control system 114 to the elevator control unit of control system 114

A8 - control unit 114 deduces, on the basis of the load information it has received, whether there is an overload in car 1 or not

A9 - if no overload is detected, the driving of elevator 1 begins

A11 - if an overload is detected, machinery brakes 160, 162 of elevator 1 are closed

A13 - the position of car 102 is examined and the overload information is kept active, until car 102 moves or moved upwards

FIG 3

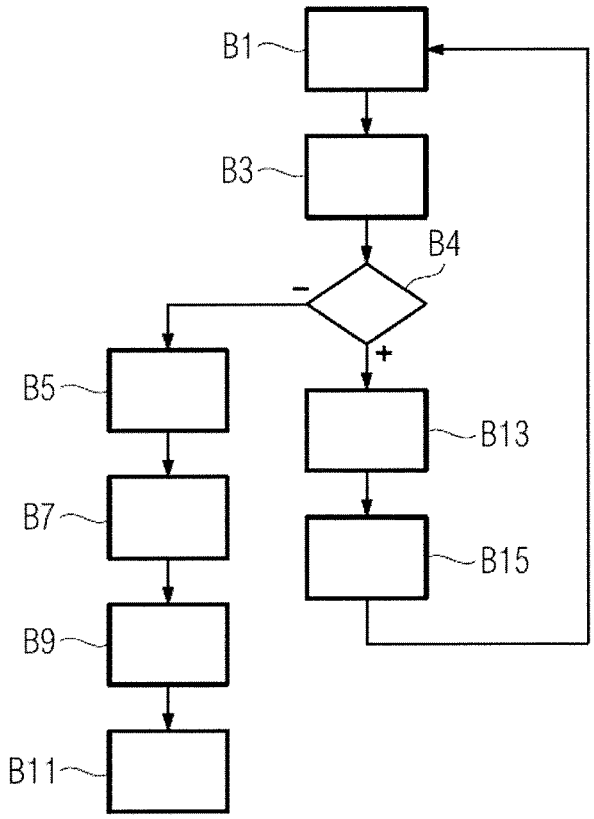

Legend

B1 - one machinery brake 160 is opened and the other machinery brake 162 is closed

B3 - a static moment downwards is made with the current of motor 110

B4 - control system 104 determines on the basis of the measurement result of speed measuring device and/or movement measuring device 115 or on the basis of information deduced from this whether or not car 102 moves or moved

B5 - the closed machinery brake 162 is opened

B7 - the moment produced from the current of motor 110 and the load of car 102 are calculated

B9 - the information is exported from the frequency converter of control system 114 to the elevator control unit of control system 114

B11 - the driving of elevator 1 begins

B13 - the open machinery brake 160 is closed

B15 - the position of car 102 is examined when both machinery brakes 160, 162 are closed, and the overload information is kept active, until car 102 moves or moved upwards

ELEVATOR CAR OVERLOAD MONITORING TO PREVENT STARTING

CROSS REFERENCE TO RELATED APPLICATIONS

This application is a Continuation of PCT International Application No. PCT/IB2014/065720, filed on Oct. 30, 2014, which claims priority under 35 U.S.C. 119(a) to Patent Application No. 20136072, filed in Finland on Nov. 1, 2013, all of which are hereby expressly incorporated by reference into the present application.

FIELD OF INVENTION

The invention relates to the field of elevator technology and more specifically to overload situations of an elevator car.

TECHNICAL BACKGROUND

In accordance with the European standard EN 81-20 "Safety rules for the construction and installation of lifts", an elevator intended for the transport of loads such as goods and persons must have a specified rated load. Item 14.2.5 of the standard requires that the elevator must be provided with a device which prevents normal starting, including relevelling, when there is an overload in the car. In accordance with the definition, exceeding the rated load by 10%, however, at least by 75 kg, is deemed to be an overload. The above-mentioned standard alone requires that it is necessary to determine the load of the car.

The load of the car has conventionally been determined for example by means of a weighing sensor attached to the floor of the car or to the elevator ropes.

The applicant's Finnish patent application 20080535 discloses a control method for the elevator motor, by which control method the elevator can be driven without previously known load information. In the method, the mechanical brake of the elevator is opened, and by controlling the controllable electronic switches of the power supply equipment, the motor current is adjusted in order to keep the car in place in the elevator shaft. The load of the elevator is deduced from the motor current or from the power/moment reference. If the load of the car exceeds the specified rated load of the car, an overload situation of the car is deduced.

International patent application publication WO 2009/087266 A1 discloses a method for the determination of the load of a car. The determination of the load is adapted in conjunction with the movement control of the elevator system. When the machinery brakes of the elevator motor are opened, load determination begins to determine the position deviation of the elevator motor. The deviation is determined by comparing the position of the rotor of the elevator motor to the initial position that the rotor had when the determination began. A speed reference of the elevator motor during the determination of load is formed on the basis of this comparison, and the speed reference is exported to the speed controller.

Japanese patent H03293277 discloses an elevator where an overload is detected by means of a device which disconnects the operation of the elevator by means of a relay and activates alarm until the load is reduced.

Japanese patent 2010143692 discloses an elevator with a calculation of the number of elevator passengers and with a calculation of the number limit based on the detection of the overload of the motor controller.

United States patent application publication US 2010/0133046 A1 discloses an elevator control system which in an overload situation prevents the doors from closing until the load of the elevator is reduced to the required level.

OBJECTIVES OF INVENTION

The determination of the load of a car requires, in accordance with the background art, the opening of the mechanical brakes of the elevator.

If an overload is detected, the drive is cancelled, the machinery brake is activated, and the passengers are asked to exit the elevator car (or in the case of goods elevators the user is asked to reduce the load of the elevator) due to overload, for example by an acoustic signal or by displaying the notification on the screen of the elevator car. However, it is difficult to detect the removal of overload.

The objective of the present invention is to facilitate the detection of the removal of an overload of the car.

The inventors of the present invention have found that opening the machinery brakes of the elevator in order to determine an overload situation of the car could, at least theoretically, be a safety risk especially if the car has a considerable overload.

A further objective of the invention is to reduce this theoretically possible safety risk related to the determination of the overload of the car in a situation where there is a significant overload in the car.

According to a very preferred embodiment, both objectives can be solved by means of an elevator and method according to the present invention.

The dependent claims describe the inventive aspects of the elevator and method respectively.

Advantages of Invention

The elevator according to the present invention comprises a control system for monitoring the load of the car, which control system is adapted to prevent the normal starting of the elevator, optionally also including relevelling, when there is an overload in the car.

The elevator further comprises at least one position measuring device, speed measuring device and/or movement measuring device in order to determine the movement and/or position of the car. The change in the position of the car when the overload is removed is preferably measured by using the measurement arrangement described in the applicant's international patent application which was published under the publication number WO 2010/018298 A1, where the linear position of the car is measured by means of a permanently-magnetised marking piece located in conjunction with the door area, which marking piece is read by means of Hall effect sensors located in conjunction with the elevator car. In this regard, the international patent application in question is incorporated into this application by reference.

The control system of an elevator is adapted to remove the prevention of normal starting when at least one said position measuring device, speed measuring device and/or movement measuring device detects that the car moved or is moving upwards in the elevator shaft.

In the method for the use of an elevator control system in monitoring the load of the car:

the normal starting of the elevator is prevented, optionally also including relevelling, when there is an overload in the car;

the position, speed and/or movement of the car is measured; and the prevention of normal starting is removed, and, where possible, also the optionally-set prevention of relevelling is removed, when it is detected that the car moved or is moving upwards in the elevator shaft.

Due to the elevator and method, the removal of overload from the car can be detected effectively.

When the control system in an elevator is adapted to detect an overload of the elevator from the motor current by keeping the car in place by means of the motor current and/or moment with the machinery brakes open and by comparing the magnitude of the motor current or moment to a pre-determined or pre-adjusted threshold value so that an overload is detected from the fact that the current or moment required by the motor is greater than the pre-determined or pre-adjusted threshold value, the removal of overload can be detected in a situation in accordance with the European standard EN-81 "Safety rules for the construction and installation of lifts" without a separate car weighing device or other corresponding monitoring device.

The elevator further comprises at least two machinery brakes, which are adapted to mechanically prevent the movement of the motor, a shaft attached to it and/or a rotating part.

Moreover, the elevator control system is adapted, when determining an overload situation, to open only some of the machinery brakes and to keep the remaining machinery brakes closed.

The method for the use of an elevator control system for determining the load situation of the car contains the steps:

to prevent the normal starting of the elevator, optionally also including relevelling, when there is an overload in the car; and to open some of the machinery brakes and to keep the remaining machinery brakes closed in order to determine the load situation.

Since at least one of the machinery brakes is closed when determining the load situation, by using the elevator or the method it is possible to better ensure, at least in theory, that the elevator stays in place if there is a great overload in the car.

When the elevator is also adapted, when determining the load situation, to create in the motor such a moment drawing the car downwards in the elevator shaft that a closed machinery brake or closed machinery brakes can keep in place at the most a determined portion of the rated load, whereby an overload is detected from the fact that the machinery brake cannot keep a loaded car in place, the safety of the detection of the overload of the car be enhanced. The mode of operation can be implemented in a manner compatible with the section of the European standard EN-81 "Safety rules for the construction and installation of lifts" concerning overload monitoring.

The portion of the nominal load is preferably approximately 110%, most preferably 110%. In this case, the elevator operates exactly in accordance with the conditions of the European standard EN-81 "Safety rules for the construction and installation of lifts".

When an elevator is also adapted to measure the motor current and when the elevator control system is adapted to deduce an overload of the car if the current or moment required to move the car is below a pre-determined or pre-adjusted threshold value, the enhancement of safety can be implemented by using load determination taking place in the electric control system.

When an elevator according to the second aspect is also adapted to measure the location and/or speed of the car and in which the control system is adapted to deduce an overload of the car if the location and/or speed of the car exceeds a pre-determined or pre-adjusted threshold value, the enhancement of safety can be implemented by measuring the actual movement of the car, and in this way sources of error potentially related to the measurement of load in the electric control system can be avoided better.

According to a very preferred embodiment of the elevator, the elevator is implemented so that the detection of overload can be implemented more safely and the removal of overload can be detected more economically.

Both the method according to the independent claim and the method according to the dependent claim are implemented most preferably in an elevator according to any one of the claims.

Most preferably, the methods according to the claims are implemented together.

LIST OF DRAWINGS

In what follows, we describe the operating principle of the elevators and methods according to the invention in more detail by reviewing the exemplary embodiments in the enclosed drawings FIG. 1-3. Of the drawings:

FIG. 1 shows functional parts of an elevator;

FIG. 2 shows the operating logic of the elevator control system and method according to the first aspect; and FIG. 3 shows the operating logic of the elevator control system and method according to the second aspect.

The same reference numbers refer to the same technical parts in all FIG.

DETAILED DESCRIPTION

FIG. 1 is a schematic diagram of some of the functional parts and safety devices of elevator 1, which in our exemplary embodiment is a rope elevator. The same drawing and a corresponding description of the functional parts and safety devices of elevator 1 can be found in drawing FIG. 1 of the applicant's international patent application WO 2005/066057 A2 and from the related description.

The foremost difference in the exemplary embodiments reviewed below as compared to that described in drawing FIG. 1 of international patent application WO 2005/066057 A2 is the way in which control system 114 of elevator 1 is programmed and how it is used. Correspondingly, the method presented below and adapted in elevator 1 for the use of elevator control system 114 in monitoring the load of a car and/or to determine the load situation differs from the method presented in international patent application WO 2005/066057 A2.

In the background art elevators to which we have referred above, in an overload situation control system 114 cannot see directly from the current of motor 110 when the overload situation has ended as people have left the elevator car (or when the user has reduced the load of the elevator).

Especially when reading what is presented below, it should be noted that elevator 1 can be implemented either as an elevator according to the first embodiment or as an elevator according to the second embodiment, or as an elevator according to both the first and second embodiment. The same also applies to the method described below.

Elevator 1 comprises elevator shaft 100, in it elevator car 102 which is moved up and down, ropes 116, 118, 120 connected to elevator car 102, drive sheaves 106, and counter weight 104. Counter weight 104 is dimensioned to have a mass equivalent to the mass of car 102 and to the mass of the mechanics on the side of car 102 related to it as well as to half of the mass of the rated load. In this case, the maximum mass difference between the sides of car 102 and counter weight 104 is half of the rated load of car 102 if there is no overload in car 102.

Rated load means the maximum permitted load to be carried in car 102.

At least two guide rails 122, 124 run on the sides and/or at the back of elevator shaft 100. The purpose of guide rails 122, 124 is to keep car 102 in place in the front and back directions with respect to counter weight 104.

Car safety devices 154, 156 available for braking car 102 are fixed to car 102. This takes place so that the brake shoes belonging to car safety devices 154, 156 are pressed against the respective linear guide rail 122, 124. Power transmission 109 is connected to drive sheaves 106 by means of shaft 107. Power transmission 109 may also include a gear system. In this case the elevator machinery has a gear system. The machinery of elevator 1 is preferably implemented without a gear system. Motor 110 is connected to power transmission 109 by means of shaft 108. Motor 110 is controlled by means of control system 114 via control cable 112. Motor 110 can have one speed, two speeds or variable speed. Motor 110 is preferably a permanent magnet synchronous motor.

Control system 114 can control the moment of motor 110 preferably steplessly, for example by means of control based on variable voltage variable frequency (V3F). Systems for the handling of car calls and push button control are further related to control system 114. Machinery brakes 160, 162 are related to shaft 108. Each machinery brake 160, 162 includes at least one brake drum which is available for braking shaft 108. Machinery brakes 160, 162 are connected to control system 114 via control cable 111. Position measuring device, speed measuring device and/or movement measuring device 115, which is for example a distance gauge and/or a speed indicator, is related to drive sheaves 106. Position measuring device, speed measuring device and/or movement measuring device 115 is connected to control system 114 via cable 119.

FIG. 2 shows an embodiment of control system 114 and method according to the first aspect of the invention.

Control system 114 includes a frequency converter that drives car 102 by rotating motor 110 by supplying a current to motor 110. Moreover, control system 114 includes an elevator control unit that forms the speed reference of elevator 1 on the basis of calls made by elevator passengers. In this case, the calculation of the current and/or moment of motor 110 takes places most preferably in the frequency converter.

In step A1, machinery brakes 160, 162 of elevator 1 are opened.

In step A3, the movement of car 102 is stopped by means of a moment accomplished by the motor current.

In step A5, the moment and load produced by motor 110 are calculated from the current of motor 110, preferably in the frequency converter of control system 114 (for example in kilograms).

In step A7, the load information calculated in step A5 is exported from the frequency converter of control system 114 to the elevator control unit of control system 114. In step A8, control unit 114 deduces, on the basis of the load information it has received, whether there is an overload in car 1 or not.

If no overload is detected, the driving of elevator 1 begins (step A9).

If an overload is detected, machinery brakes 160, 162 of elevator 1 are closed in step A11. In step A13, the position of car 102 is examined and the overload information is kept active, until car 102 moves or moved upwards.

FIG. 3 shows an embodiment of control system 114 and method according to the second aspect of the invention. This exemplary embodiment also implements control system 114 and method according to the first aspect of the invention.

In step B1, one machinery brake 160 is opened. The other machinery brake 162 is closed.

In step B3, a static moment downwards is made with the current of motor 110, in other words the moment directs on car 102 a force in the direction of ropes 116, 118, 120, which force tends to pull car 102 downwards in elevator shaft 100. Car 102 moves against closed brake 162 only of there is an overload in car 102. This is so because the only holding brake 160 can only keep a rated load of 110% in place.

In step B4, control system 104 determines on the basis of the measurement result of speed measuring device and/or movement measuring device 115 or on the basis of information deduced from this whether or not car 102 moves or moved.

If car 102 moves or moved, there is an overload in car 102. In this case, even the open machinery brake 160 is closed in step B13. In step B15, the position of car 102 is examined (on the basis of the measurement result of speed measuring device and/or movement measuring device 115 or on the basis of information deduced from this) when both machinery brakes 160, 162 are closed, and the overload information is kept active, until car 102 moves or moved upwards.

If car 102 did not move, there is no overload in car 102, and in step B5 also the closed machinery brake 162 is opened. In step B7, the moment produced from the current of motor 110 and the load of car 102 are calculated (for example in kilograms). The information is exported from the frequency converter of control system 114 to the elevator control unit of control system 114. In step B11, the driving of elevator 1 begins.

In other words, during the time that elevator 1 starts to move, the load of car 102 is calculated from the motor current or so that one machinery brake 160 of motor 102 is opened (the other machinery brake 162 is closed) and motor 102 with its shafts 107, 108 and potential power transmission 109 and drive sheaves 106 forms electrically such a moment that the only holding machinery brake 162 can keep in place a load of only 110%. If an overload situation is detected, in other words too high a current of motor 110 or too great a movement of car 102 (or movement of elevator 1), then also the other machinery brake 160 of motor 110 is closed and the start is cancelled. The removal of the overload situation can be detected from the movement of car 102 for example so that the position of car 102 moves upwards when the load leaves car 102.

The invention should not be understood to be limited only by the below claims, but the invention is to be understood to include all their legal equivalents and the combinations of the embodiments presented.

Especially, even though elevator 1 in the exemplary embodiment shown in FIG. 1 has a suspension ratio of 1:1, in other words in it the ropes 116, 118, 120 end up in car 102 at one end and in counter weight 104 at the other end, the invention can be adapted to be also used in elevators with another suspension ratio. As an example of such elevators provided with another suspension ratio, we mention the suspension ratio of 1:2, where a mule pulley is fastened to car 102 or to counter weight 104, through which mule pulley ropes 116, 118, 120 run and do not hence end up in car 102 or in counter weight 104.

In the exemplary embodiment of FIG. 1, counter weight 104 is dimensioned to correspond to the mass of car 102 and to half of the mass of the rated load (so-called 50% balancing). It should be taken into account that the mass of counter weight 104 could also have been chosen otherwise. Counter weight 104 can especially be lighter in weight, whereby the weight of counter weight 104 corresponds approximately to the mass of car 102 plus 20-40% of the mass of the rated load.

LIST OF REFERENCE NUMBERS USED

1 elevator
100 elevator shaft
102 car
104 counter weight
106 drive sheaves
107 shaft
108 shaft
109 power transmission
110 motor
111 control cable
112 control cable
114 control system
115 position measuring device, speed measuring device and/or movement measuring device
116, 118, 120 ropes
119 cable
122, 124 linear guide rail
154, 156 mechanical brake
160, 162 machinery brake

The invention claimed is:

1. An elevator which comprises a control system for monitoring the load of a car, which control system is adapted to prevent the normal starting of the elevator when there is an overload in the car, wherein:

the elevator comprises at least one position measuring device, speed measuring device and/or movement measuring device in order to determine the movement and/or position of the car; and the control system of the elevator is adapted to remove the prevention of normal starting when at least one said position measuring device, speed measuring device and/or movement measuring device detects that the car moved or is moving upwards in the elevator shaft.

2. The elevator according to claim 1, where the control system is adapted to detect an overload of the elevator from the motor current by keeping the car in place by means of the motor current and/or moment with the machinery brakes open and by comparing the magnitude of the motor current or moment to a pre-determined or pre-adjusted threshold value so that an overload is detected from the fact that the current or moment required by the motor is greater than the pre-determined or pre-adjusted threshold value.

3. The elevator according to claim 1, which comprises:

at least two machinery brakes, which are adapted to mechanically prevent the movement of the motor, a shaft attached to the motor and/or a rotating part; and the control system of which is adapted, when determining an overload situation, to only open some of the machinery brakes and to keep the remaining machinery brakes closed.

4. The elevator according to claim 3, which is also adapted, when determining the load situation, to create in the motor such a moment drawing the car downwards in the elevator shaft that a closed machinery brake or closed machinery brakes can keep in place at the most a determined portion of the rated load, whereby an overload is detected from the fact that the machinery brake cannot keep a loaded car in place.

5. The elevator according to claim 4, where the portion is about 110%.

6. The elevator according to claim 3, which is further adapted to measure the current of the motor and where the control system is adapted to deduce an overload of the car if the current is below the pre-determined or pre-adjusted threshold value.

7. The elevator according to claim 3, which is further adapted to measure the position, speed and/or movement of the car and where the control system is adapted to deduce an overload of the car if the position, speed and/or movement of the car exceeds the pre-determined or pre-adjusted threshold value.

8. A method for the use of a control system of an elevator in monitoring the load of a car, said method comprising the steps of:

preventing the normal starting of the elevator when there is an overload in the car;

measuring the position, speed and/or movement of the car; and removing the prevention of the normal starting when it is detected that the car moved or is moving upwards in the elevator shaft.

9. The method according to claim 8, where the control system of the elevator is used for determining the load situation of the car, said method further comprising the steps of:

preventing the normal starting of the elevator when there is an overload in the car; and opening some of the machinery brakes and keeping the remaining machinery brakes closed in order to determine the load situation.

10. The method according to claim 8, further comprising the step of using an elevator which comprises a control system for monitoring the load of a car, which control system is adapted to prevent the normal starting of the elevator when there is an overload in the car, wherein:

the elevator comprises at least one position measuring device, speed measuring device and/or movement measuring device in order to determine the movement and/or position of the car; and the control system of the elevator is adapted to remove the prevention of normal starting when at least one said position measuring device, speed measuring device and/or movement measuring device detects that the car moved or is moving upwards in the elevator shaft.

11. The elevator according to claim 2, which comprises:

at least two machinery brakes, which are adapted to mechanically prevent the movement of the motor, a shaft attached to the motor and/or a rotating part; and the control system of which is adapted, when determining an overload situation, to only open some of the machinery brakes and to keep the remaining machinery brakes closed.

12. The elevator according to claim 4, which is further adapted to measure the current of the motor and where the control system is adapted to deduce an overload of the car if the current is below the pre-determined or pre-adjusted threshold value.

13. The elevator according to claim 5, which is further adapted to measure the current of the motor and where the control system is adapted to deduce an overload of the car if the current is below the pre-determined or pre-adjusted threshold value.

14. The elevator according to claim 4, which is further adapted to measure the position, speed and/or movement of the car and where the control system is adapted to deduce an overload of the car if the position, speed and/or movement of the car exceeds the pre-determined or pre-adjusted threshold value.

15. The elevator according to claim 5, which is further adapted to measure the position, speed and/or movement of the car and where the control system is adapted to deduce an overload of the car if the position, speed and/or movement of the car exceeds the pre-determined or pre-adjusted threshold value.

16. The elevator according to claim 6, which is further adapted to measure the position, speed and/or movement of the car and where the control system is adapted to deduce an overload of the car if the position, speed and/or movement of the car exceeds the pre-determined or pre-adjusted threshold value.

* * * * *